United States Patent [19]

Whitt

[11] 4,373,709

[45] Feb. 15, 1983

[54] SURGICAL LIMB HOLDER

[76] Inventor: Everett D. Whitt, 3504 Rivercrest Dr., Columbus, Ohio 43223

[21] Appl. No.: 190,193

[22] Filed: Sep. 24, 1980

[51] Int. Cl.[3] ..... A61G 13/00

[52] U.S. Cl. ..... 269/328; 128/133; 128/346

[58] Field of Search ..... 128/134, 303 R, 346, 128/133; 269/328, 324, 322; 250/439 R, 451, 456; 5/443; 27/13, 21

[56] References Cited

U.S. PATENT DOCUMENTS

| | | | |
|---|---|---|---|
| 473,200 | 4/1892 | Streeter | 269/328 |
| 988,923 | 4/1911 | Bauerfeind | 269/328 |
| 2,446,930 | 8/1948 | Hower | 269/328 X |
| 2,535,559 | 12/1950 | Wolf | 269/328 |
| 2,732,269 | 1/1956 | Astroff | 269/328 |
| 2,757,058 | 7/1956 | Broesel | 269/328 |
| 2,850,342 | 9/1958 | Robinson | 269/328 |
| 3,452,978 | 7/1969 | Creelman | 269/328 |

*Primary Examiner*—Michael H. Thaler
*Attorney, Agent, or Firm*—Robert B. Watkins

[57] ABSTRACT

A surgical limb holder having a stanchion with lateral support members which hold adjustable restraining members that move into contact with a limb and hold it in optimum position for surgery.

5 Claims, 3 Drawing Figures

SURGICAL LIMB HOLDER

SUMMARY OF THE INVENTION

This invention relates to a surgical limb holder. More particularly, it relates to an apparatus for holding the limb of a person or animal while surgical procedures are performed on the limb.

Briefly and in summary, the invention is a limb holder having an upstanding stanchion with a support at the top on which a pair of oppositely disposed restrainer members are slidably engaged. The restrainer members are placed on opposite sides of the limb and brought into supporting, restraining engagement with the limb. They are then clamped in place holding the limb in a position desired by the surgeon during surgical procedures.

The invention is readily adjustable to a great variety of sizes, positions, and attitudes so that the limb can be held in any position which will enhance and facilitate surgery.

Although various devices and apparatuses have been used to hold limbs, including arms and particularly legs, while surgery is performed, those previously used prior to this invention have not been entirely satisfactory for one reason or another. In many cases the general procedure remains that attendants hold the limb in the position desired by a surgeon during the operation. This is tiring and consequently tends to become unstable as the operation progresses.

Prior patented devices such as shown in U.S. Pat. No. 2,732,269 have been lacking in facilities for clamping and holding the limb firmly. Other patented devices such as shown in U.S. Pat. No. 2,850,342 lack facilities for adjustment in attitude.

In order to overcome the inadequacies of prior devices, the apparatus of the present invention has important objectives and features. Among those are convenience to use and ease in set up. In addition, it is adapted for clamping to any surgical table. The invention is adjustable to various size limbs and is adjustable to various heights. It provides a variety of angles that are needed for diagnostic and surgical arthroscopy. When a limb is in the apparatus, access to the limb is easy which is very helpful during surgery preparation. The apparatus of this invention affords one hand control of the varus or valgus opening during diagnostic arthroscopy, and this is without the need of an assistant. During surgical arthroscopy an assistant easily controls the attitude of flexion angle, as well as the medial or lateral opening, entirely from a position at the foot of the patient. The construction features permit lengthy applications of varus or valgus stress without assistant fatigue or unsteadiness.

The apparatus permits good stabilization of the limb and allows surgery without a tourniquet. In addition the apparatus is adjustable to various patients and is easy to clean.

As an additional feature the apparatus is provided with padding for the comfort of the patient. The padding is easily inserted and readily removed, and may be of disposable materials so that no laundering is required.

Other objects and features of the invention will be apparent and understood from the detailed description of the invention and the accompanying drawings which follow.

DETAILED DESCRIPTION OF THE INVENTION

Figure 1:
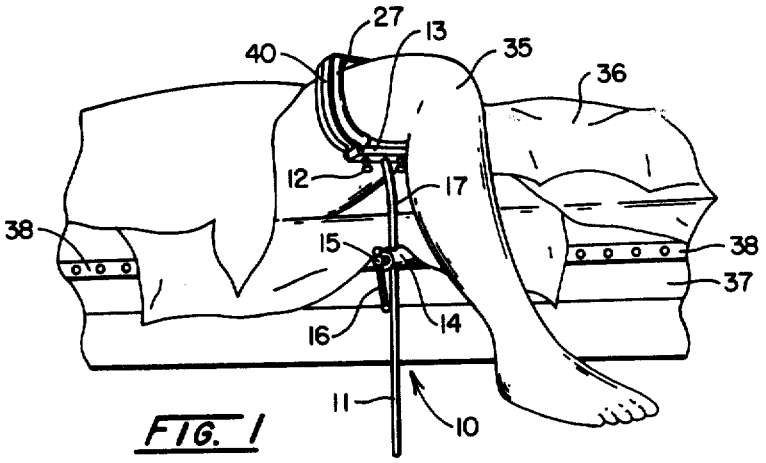
FIG. 1 is a perspective view of the apparatus of this invention in use on an operating table with the limb of a patient positioned for surgery.
Figure 2:
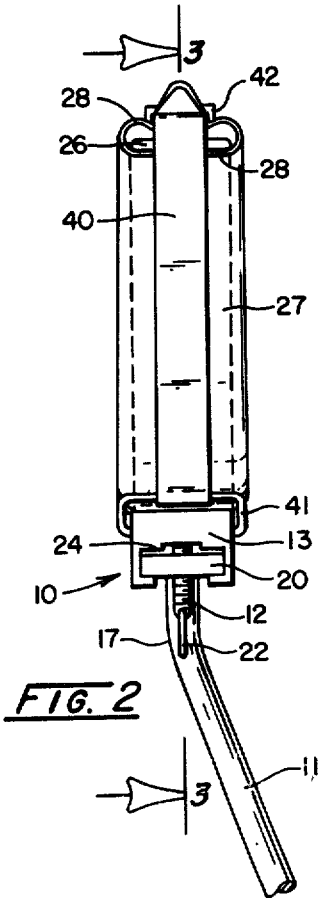
FIG. 2 is an elevational view of the end portion of the apparatus of this invention.
Figure 3:
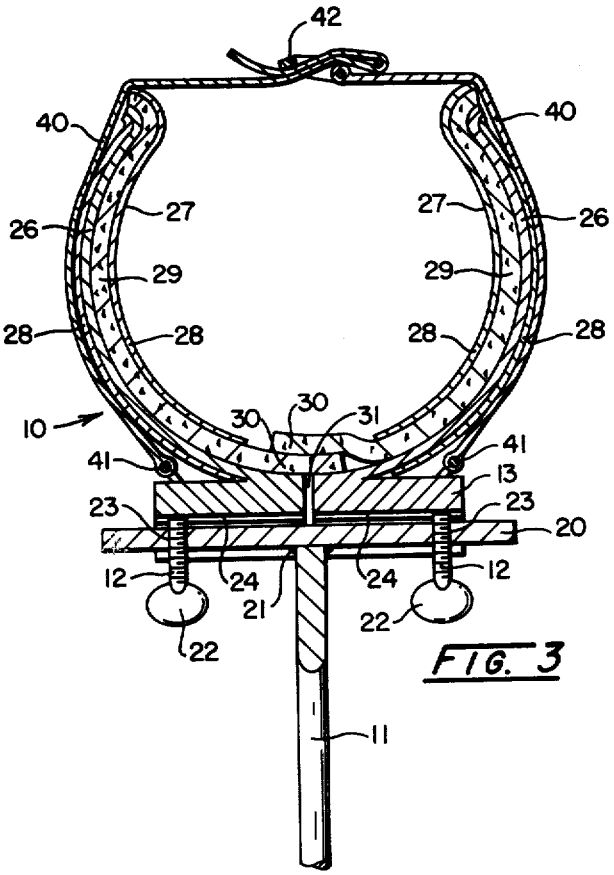
FIG. 3 is a partially sectional and elevational view of the apparatus of this invention, taken along the line 3—3 of FIG. 2.

Referring to the FIGS. 1, 2 and 3, where like numerals indicate the same parts, the limb holder 10 comprises a stanchion member 11, clamping means 12 and restrainer members 13.

Stanchion member 11 is adapted to slide and rotate in a vise 14, which is commonly found as a part of a surgical operating table 37. The vise 14 has a screw 15 and handle 16 which are used to tighten the holding pressure on the stanchion 11. The vise is positionable along the sides or ends of the operating table 37 on a track 38 which in conventional practice circumvents and is a part of the operating table.

The stanchion member 11 is preferably a generally vertically oriented cylindrical stainless steel rod like leg and is constructed with a deflection in form 17 providing a change in attitude of the restraining member 13 upon rotation of the stanchion 11 in the vise 14. The stanchion 11 is provided with a lateral support member 20 fastened at the upper end by suitable means such as a weld 21. The lateral support member 20 and the stanchion 21 make up a generally T-shaped composite unit as most clearly seen in FIG. 3.

The clamping means 12 is, in its preferred form, a threaded thumb screw 22 which engages in a threaded hole 23 in the support 20.

The restrainer members 13 are provided with slots 24 constructed to slidingly engage and hold the support 20. By this construction, the restrainer members 13 move back and forth upon the support 20 and are clamped at a fixed position by rotation of the thumb screws 22 of the clamping means 12. The movement back and forth of the restrainer means 13 allows for adjustment of the limb holder 10 to fit various size limbs as necessary to provide the correct support without discomfort to the patient.

Restrainer members 13 are provided with upstanding generally arcuate limb conforming stays 26. Restrainer members 13 may be cast or fabricated of one piece and are preferably stainless steel to facilitate cleaning and sterilization as necessary in the surgical procedures.

Each stay 26 is provided with a pre-formed pad 27 comprising an outer layer 28 which circumvents the stay and holds an inner layer 29 in an open inner chamber. Inner layers 29 are provided with extensions 30 that overlap at the gap 31 which occurs when the restrainer members 13 are adjusted at positions other than the minimum distance between.

The padding 27 may be any typical surgical grade of soft and pliable material such as cotton, gauze, or paper products.

Although not absolutely necessary for the use of the invention, in some situations a strap means 40 may be attached to an eyelet 41 on each restrainer member 13. The strap means 40 are provided with adjustable closure clasp means 42. The clasp 42 may be of conventional fold over type or other suitable construction.

Referring to FIG. 1, a leg 35 of a patient is positioned in the stays 26 of the restrainer members 13 while the remainder of the patient's torso 36 rests upon the operating table 37.

The stanchion 11 is rotated and raised or lowered until the angle and attitude of the stays 26 are most conveniently located for the surgical procedure which is to be performed. By loosening the thumb screws 22, the distance between stays can be increased or decreased until the proper fit is obtained on the limb 35. Since the adjustment means 12 and vise 14 are conveniently located in the operating station, changes may be made readily during the operating procedure yet the apparatus is stable unless a change is needed.

An important advantage of the construction of this invention is the facility for arranging and holding the limb 35 over the edge (i.e. dangling over) of the operating table 37. This permits the joint to be flexed and fully bent as necessary during the operating procedures. This also assists in drainage.

In some procedures, it may be found an advantage to fasten the strap means 40 as a further restrainer for the limb.

While the preferred means of adjustment for the restraining members 13 on the support 12 are shown as the groove 24 and the thumb screw 22 in the support 20, it will be apparent that other clamping means might be used, such as screws engaged in the restraining members 13 pressing against the supports 12. Spring loaded detents of various kinds could be used.

The construction shown in FIG. 1, 2, and 3 is preferred because the thumb screws 22 are close and handy to the operating station without being in the way. The slots 24, extending the full length of the restrainer members 13, provide good longitudinal support and stability to the stays 26.

Although the limb holder is shown and disclosed in use holding a human leg, it could be used to hold a human arm or even be constructed to hold animal limbs in veterinary surgery where the advantages of the invention would be helpful.

It is herein understood that although the present invention has been specifically disclosed with the preferred embodiments and examples, modification and variations of the concept herein disclosed may be resorted to by those skilled in the art. Such modifications and variations are considered to be within the scope of the invention and the appended claims.

What is claimed is:

1. A limb holder for surgical procedures comprising:

(a) a vise constructed for attachment on a table means for the surgical procedures, (b) a stanchion member comprising a generally vertically oriented rod-like leg constructed to adjustably slide and rotate in the vise and having a lateral support member fastened at the upper end, the leg having a deflection in form of less than 90° intermediate the vise and the lateral support member, to change the angle, attitude, and height of the limb holder upon adjustment in the vise, the vise having means for tightening the holding pressure on the stanchion and fixedly maintaining the angle, attitude and height of the limb holder, (c) oppositely placed generally symmetrical restrainer members adjustably engaged on the stanchion member, the restrainer members having upstanding generally arcuate and limb conforming stays positioned to cooperatively support and restrain a limb; and (d) clamping means on the limb holder, constructed to hold the restraining members at fixed positions on the lateral support member, the restrainer members being slidingly engaged on the lateral supports, and the clamping means being on the lateral supports.

2. A limb holder according to claim 1 wherein the lateral support is in the form of a T at the top of the stanchion member, has the shape of a plate of rectangular cross-section, and the restainer members are provided with a slot slideably engaged on the plate.

3. A limb holder according to claim 2 wherein the clamping means is a screw threaded through the plate and engageable on the restrainer members.

4. A limb holder according to claim 3 wherein the restrainer members are provided with strap means with an adjustable clasp to close the top of the limb holder over a limb.

5. A limb holder according to claim 1 wherein the restraining members are provided with padding at the position of interface with a restrained limb and the padding is in the form of a sleeve having an outer layer circumventing an open chamber with an open end and an inner layer which partially fills the open end, the inner layer extending beyond the open end to overlap an adjacent padding.

* * * * *